US009739031B2

(12) United States Patent
Miller

(10) Patent No.: US 9,739,031 B2
(45) **Date of Patent: *Aug. 22, 2017**

(54) EXPANDING MATERIAL BOX FOR EQUIPMENT

(71) Applicant: Meyer Products LLC, Cleveland, OH (US)

(72) Inventor: Thomas A. Miller, Waterloo, IN (US)

(73) Assignee: Meyer Products, LLC, Cleveland, OH (US)

( * ) Notice: Subject to any disclaimer, the term of this patent is extended or adjusted under 35 U.S.C. 154(b) by 250 days.

This patent is subject to a terminal disclaimer.

(21) Appl. No.: 14/541,757

(22) Filed: Nov. 14, 2014

(65) Prior Publication Data

US 2015/0068780 A1 Mar. 12, 2015

Related U.S. Application Data

(63) Continuation of application No. 13/372,470, filed on Feb. 13, 2012, now Pat. No. 8,887,413.

(51) Int. Cl.
*E02F 3/815* (2006.01)
*E01H 5/06* (2006.01)

(52) U.S. Cl.
CPC ..... *E02F 3/815* (2013.01); *E01H 5/065* (2013.01); *E02F 3/8155* (2013.01)

(58) Field of Classification Search
CPC . E02F 3/815; E02F 3/76; E02F 3/7654; E02F 3/8155
See application file for complete search history.

(56) References Cited

U.S. PATENT DOCUMENTS 2,218,512 A * 10/1940 Ball ..... E01H 5/06 172/812
3,039,209 A 6/1962 Cron et al.
3,182,410 A * 5/1965 Schiavi ..... E02F 3/815 172/701.3
3,559,749 A * 2/1971 Fryrear ..... E02F 3/8155 172/664
4,073,077 A 2/1978 Essel et al.
4,084,643 A * 4/1978 Easterling ..... E02F 3/7645 172/743
RE31,045 E 10/1982 Essell et al.
4,369,847 A * 1/1983 Mizunuma ..... E02F 3/815 172/701.1
5,165,191 A * 11/1992 Davis ..... E02F 3/40 172/818
5,392,538 A * 2/1995 Geerligs ..... E01H 5/061 37/236
5,638,618 A 6/1997 Niemela et al.
(Continued)

*Primary Examiner* — Thomas B Will
*Assistant Examiner* — Jessica H Lutz
(74) *Attorney, Agent, or Firm* — Roger D. Emerson; Emerson Thomson Bennett, LLC

(57) ABSTRACT

A material box can telescope between larger and smaller widths to accommodate legal requirements of traveling down the road, making traveling between job sites easier and safer than conventional, unadjustable material boxes. The material box can be used in a wide configuration to plow a wider area, such as empty parking lots, cutting down work time. When cars are present, the material box can be made narrow to accommodate for the vehicles while still being an effective material moving device.

19 Claims, 8 Drawing Sheets

(56) References Cited

U.S. PATENT DOCUMENTS

| | | | |
|---|---|---|---|
| 6,408,549 | B1 | 6/2002 | Quenzi et al. |
| 6,412,199 | B1 | 7/2002 | Quenzi et al. |
| 6,425,196 | B1 | 7/2002 | Weagley et al. |
| 6,442,877 | B1 | 9/2002 | Quenzi et al. |
| 7,000,338 | B2 | 2/2006 | Savard |
| 7,429,158 | B2 | 9/2008 | McFarland |
| 7,481,011 | B2 | 1/2009 | Nesseth |
| 7,658,022 | B2 | 2/2010 | Strait |
| 7,681,337 | B2 | 3/2010 | Watson |
| 2007/0089327 | A1 | 4/2007 | Watson |
| 2009/0307943 | A1 | 12/2009 | Buckbee et al. |

* cited by examiner

EXPANDING MATERIAL BOX FOR EQUIPMENT

CROSS REFERENCE TO RELATED APPLICATIONS

This is a continuation of U.S. patent application Ser. No. 13/372,470, entitled "EXPANDING MATERIAL BOX FOR EQUIPMENT", filed Feb. 13, 2012, which is incorporated herein by reference.

BACKGROUND OF THE INVENTION

1. Field of the Invention

The present invention relates to material boxes and, more particularly, to an expanding material box for equipment.

2. Description of the Related Art

Transporting a material box between locations can be dangerous and illegal, depending on the size of the box. Moreover, to accommodate locations where travel width varies, such as parking lots, multiple size boxes may be needed.

As can be seen, there is a need for an improved material box that has an adjustable width to permit legal and safe transportation while adjusting in size to allow for various applications.

SUMMARY OF THE INVENTION

In one aspect of the present invention, a material box assembly includes a center blade assembly having a center main blade with a curved plate structure and having a pair of lateral ends and at least one channel attached to a back side of the curved plate structure of the center main blade that extends to at least one of the pair of lateral ends of the center main blade and having a C-shaped cross sectional shape. The channel and the back side of the center main blade define a first gap therebetween at a lateral end of the channel. The material box assembly further includes at least one wing blade assembly having a wing blade and a wing blade slide that is slidably engaged with the channel to adjust the width of the material box. The wing blade is slidable in transverse directions within the first gap at the back side of the center main blade, with each wing blade slide having a cross sectional shape which mates with and slides within the C-shaped cross sectional shape of a corresponding channel. Each wing blade is positioned behind the center main blade and has a curvature that allows transverse sliding of the wing blade relative to the center main blade.

In another aspect of the present invention, a material box assembly includes a center blade assembly having a center main blade with a curved plate structure that has a pair of lateral ends and includes a back drag blade that defines an edge of the center main blade, and at least one channel attached to a back side of the curved plate structure of the center main blade that extends to at least one of the pair of lateral ends of the center main blade and having a C-shaped cross sectional shape. The channel and the back side of the center main blade define a first gap therebetween at a lateral end of the channel. The material box assembly further includes at least one wing blade assembly having a wing blade and a wing blade slide that is slidably engaged with the channel to adjust the width of the material box. The wing blade is slidable in transverse directions within the first gap at the back side of the center main blade, with each wing blade slide having a cross sectional shape which mates with and slides within the C-shaped cross sectional shape of a corresponding channel. Each wing blade is positioned behind the center main blade and has a curvature that allows transverse sliding of the wing blade relative to the center main blade.

These and other features, aspects and advantages of the present invention will become better understood with reference to the following drawings, description and claims.

DETAILED DESCRIPTION OF THE INVENTION

Figure 1:
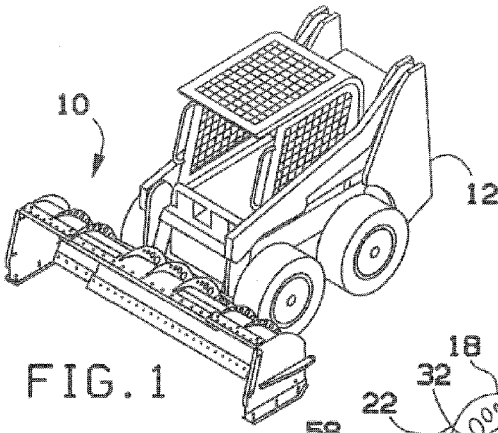
FIG. 1 is a perspective view of an adjustable material box, in use, according to an exemplary embodiment of the present invention.
Figure 2:
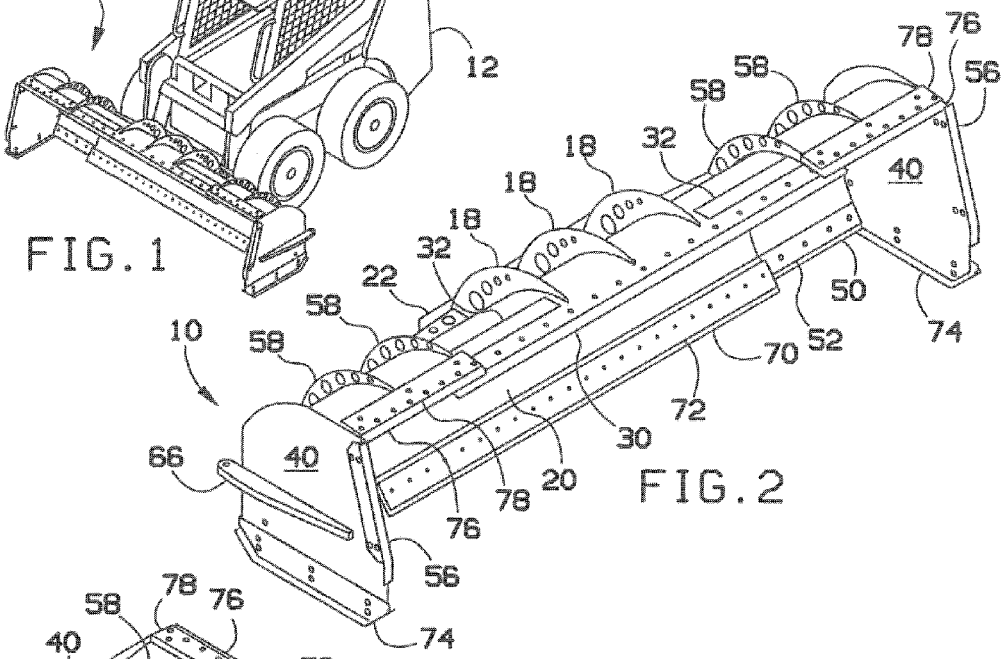
FIG. 2 is a front perspective view of the adjustable material box of FIG. 1.
Figure 3:
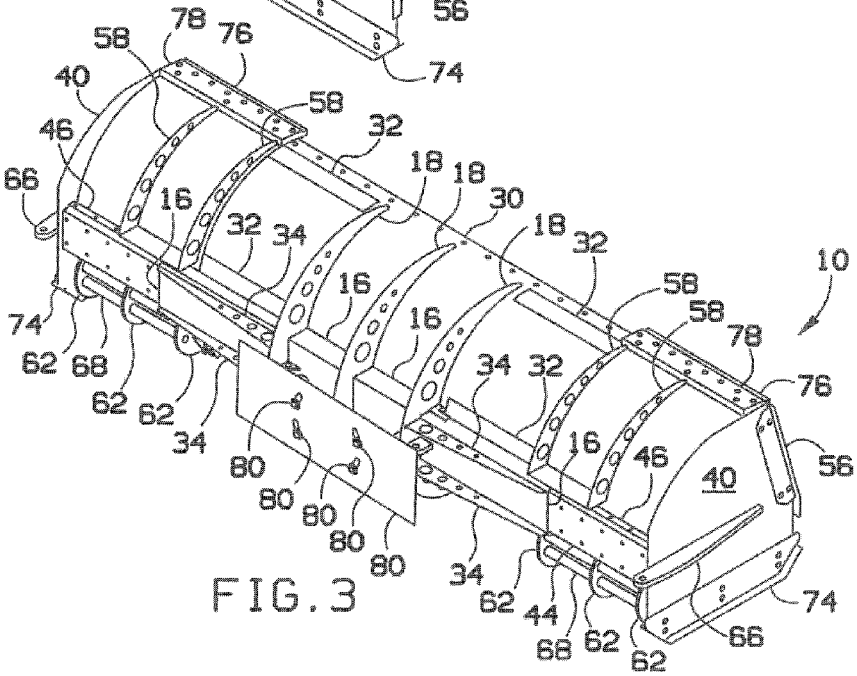
FIG. 3 is a rear perspective view of the adjustable material box of FIG. 1.
Figure 4:
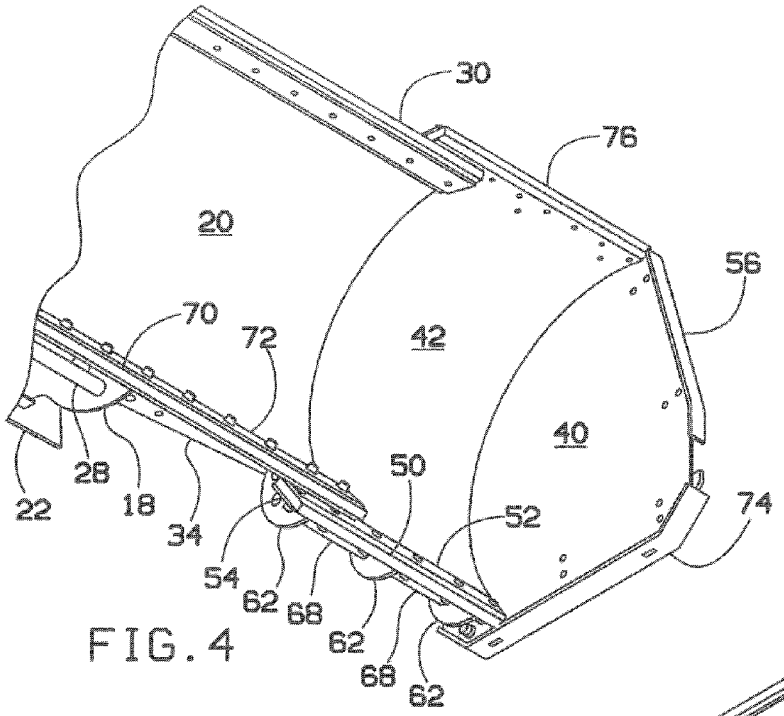
FIG. 4 is a perspective view of a bottom right side of the adjustable material box of FIG. 1.
Figure 5:
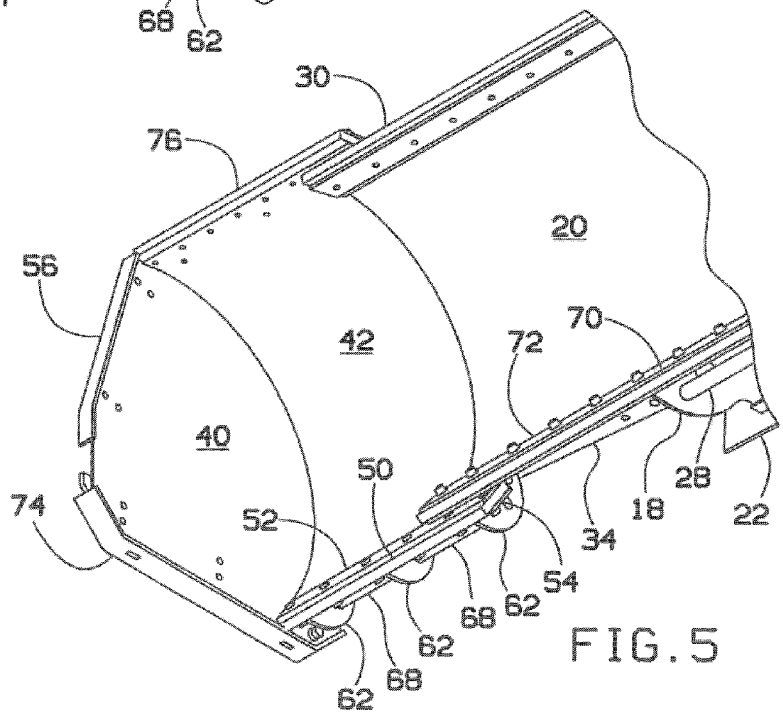
FIG. 5 is a perspective view of a bottom left side of the adjustable material box of FIG. 1.
Figure 6:
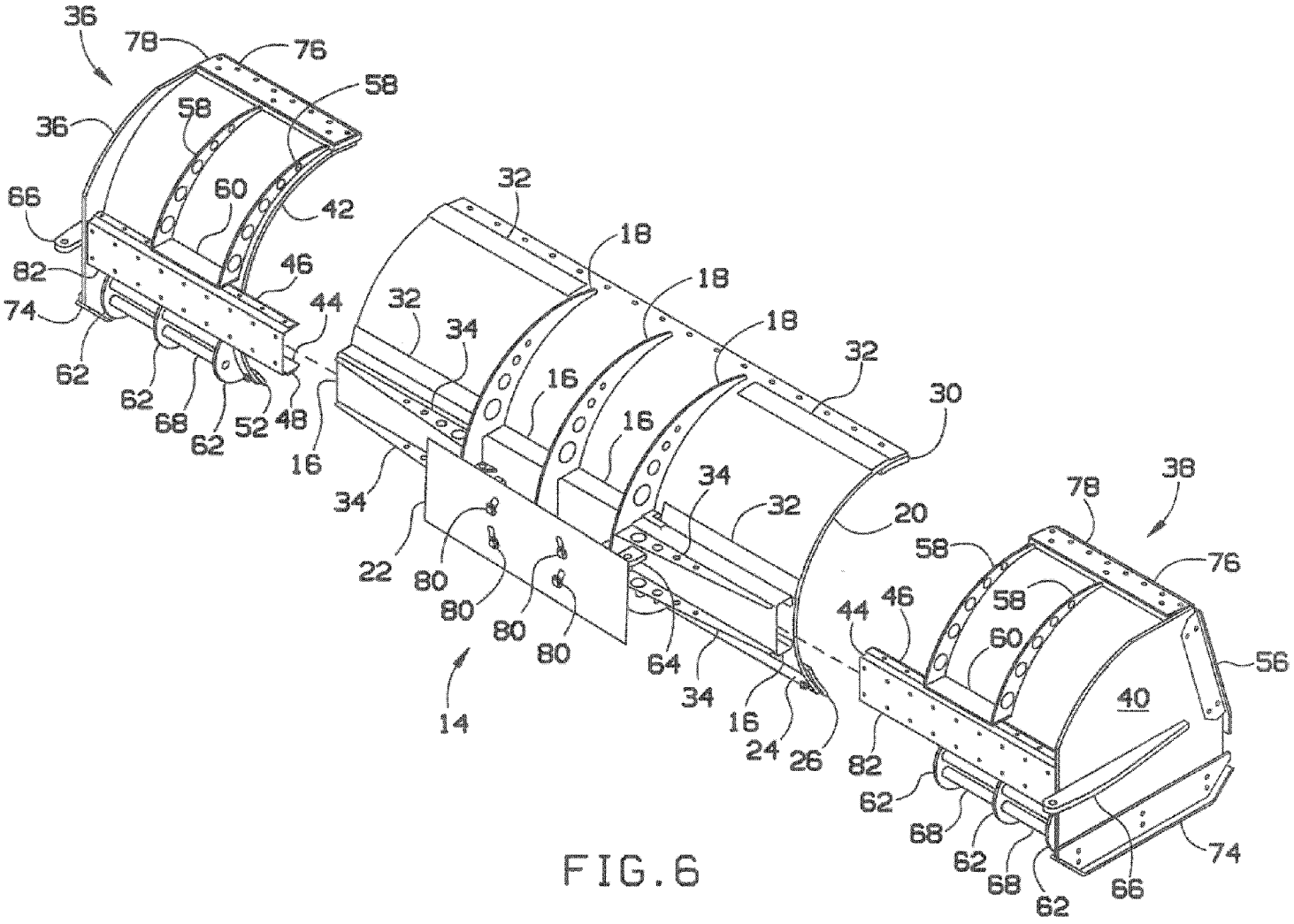
FIG. 6 is an exploded perspective view of the adjustable material box of FIG. 1.
Figure 7:
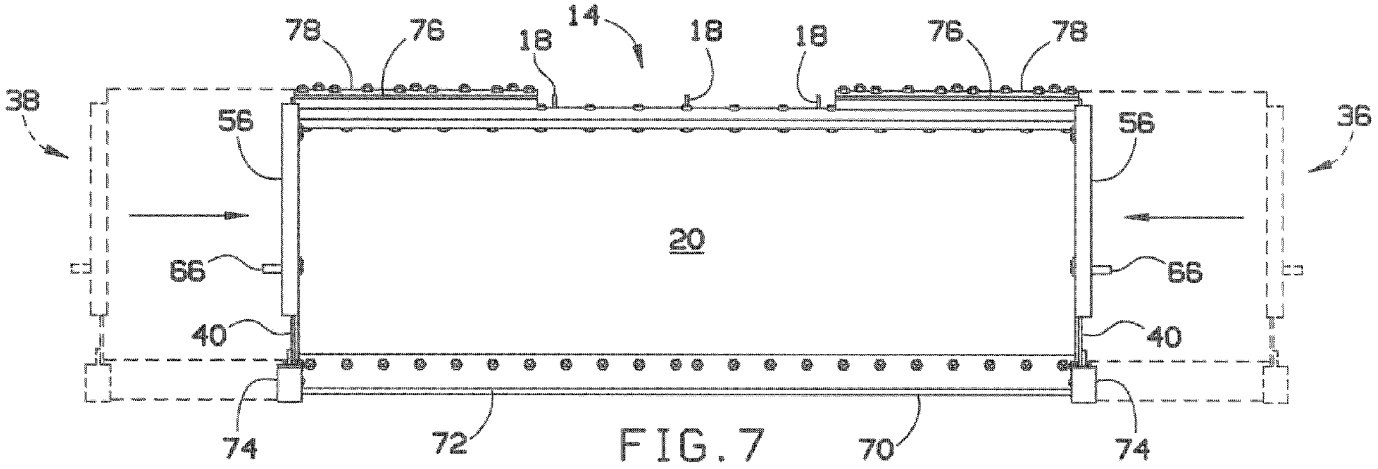
FIG. 7 is a front view of the adjustable material box of FIG. 1 with wing assemblies closed.
Figure 8:
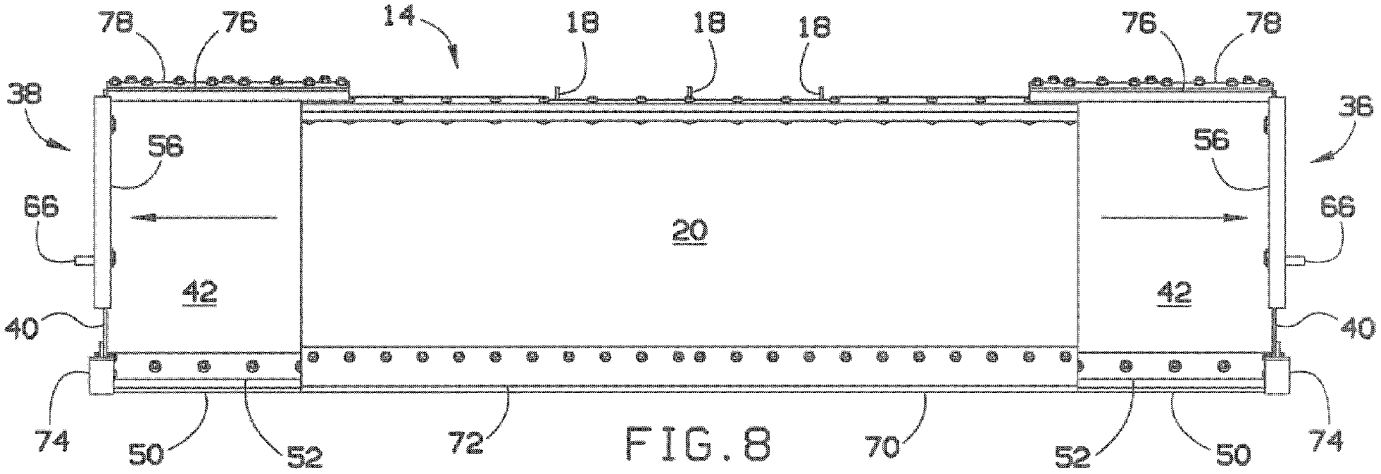
FIG. 8 is a front view of the adjustable material box of FIG. 1 with wing assemblies open.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a material box that can telescope between larger and smaller widths to accommodate legal requirements of traveling down the road, making traveling between job sites easier and safer than conventional, unadjustable material boxes. The material box can be used in a wide configuration to plow a wider area, such as empty parking lots, cutting down work time. When cars are present, the material box can be made narrow to accommodate for the vehicles while still being an effective material moving device.

Referring now to FIGS. 1 through 8, a material box assembly 10 may be used by, for example, a skid loader 12 for moving material in applications such as landscape, agricultural, snow removal and the like. It should be appreciated that the material box assembly 10 can also be referred to as a material moving assembly and does not necessarily need to have a box shape. The material box assembly 10 may include a center blade assembly 14 and one or two adjustable wing blade assemblies 36, 38. The center blade assembly 14 may include a mount 22 for attaching the material box assembly 10 to the skid loader 12. Other mounts may be used depending on the application. Mount hardware 80 may be used to attach the mount 22 to the center blade assembly 14.

A main C-channel frame 16 may be disposed on the back side of the center blade assembly 14. The main C-channel frame 16 may slidably accept wing blade slides 44 from the wing blade assemblies 36, 38. When the wing blade assemblies 36, 38 are slid onto the main C-channel frame 16, the wing blades 42 slide behind a center main blade 20 of the center blade assembly 14.

In a narrow configuration (FIG. 7), the wing blade assemblies 36, 38 may be fully slid onto the center blade assembly 14 so that wing blade sides 40 are adjacent to the edges of the center main blade 20. In a wide configuration (FIG. 8), the wing blade assemblies 36, 38 may be extended outward, away from the center main blade 20. Hydraulics (not shown) may be used to adjust the wing blade assembly 36, 38. A hydraulic cylinder (not shown), for example, may connect between outer ram mounts 66 of the wing blade assembly 36, 38 and inner ram mounts 64 on the center blade assembly. In some embodiments, the wing blade assemblies 36, 38 may be manually moved between positions. In this manual embodiment, pins (not shown) may be inserted through the main C-channel frame 16 and the wing blade slide 44 to hold the wing blade assemblies 36, 38 in a desired position.

To provide smooth adjustment of the width of the material box assembly 10, slides may be provided at various locations. For example, an upper wing blade slide 46 and a lower wing blade slide 48 may be disposed on each side of the wing blade slides 44. These slides 46, 48 may provide ease of motion of the wing blade slides 44 within the main C-channel frames 16. In addition, a center main blade slide 32 may be disposed on the center blade assembly 14. These slides 32 may provide ease of motion of the wing blades 42 over the center main blade 20. Additionally, a wing blade rear slide 82 may be disposed on the wing blades 42. The slides may be made of a durable material that may permit ease of motion between the sliding parts. For example, the slides may be made from a hard, smooth plastic.

Support structures may be included in the material box assembly 10. For example, located above the main C-channel frame 16, center gussets 18 may run along a back side of the center main blade 20. Likewise, located above the wing blade slides 44, wing upper gussets 58 may run along a back side of the wing blades 42. Wing upper gusset lower supports 60 may interconnect the wing upper gussets 58 adjacent to the wing blade slides 44. Below the wing blade slides 44, wing lower cutting edge gussets 62 may be disposed with wing lower gusset pipes 68 interconnecting the wing lower cutting edge gussets 62. Similarly, below the main C-channel frame 16 on the center blade assembly 14, pipes 28 may be disposed for support. Additionally, along the main C-channel frame 16, main C-channel gussets 34 may be disposed to provide additional support for the main C-channel frame 16.

Additional components may be included on the material box assembly 10, such as a cutting edge backing plate 24 and a center rubber 26 disposed along a scraping edge of the center main blade 20. A front center cutting edge 30 may be disposed on a cutting edge of the center main blade 20. Similarly, the wing blade assemblies 36, 38 may include a wing back drag cutting edge 76 and a wing back drag backing plate 78 on a cutting edge of the wing blade 42. A back drag rubber edge 70 and a back drag cutting edge 72 may be disposed on the center main blade 20, while a wing front cutting blade 50 and a wing rubber slider 52 may be disposed on the wing blades 42. Wing rear backing plates 54 may be disposed behind the wing front cutting blades 50. Back drag skis 74 may be disposed on each end of the bottom of the wing blades 42. Wing blade side skis 56 may be disposed along the leading front edges of the wing blade sides 40.

Figure 11:
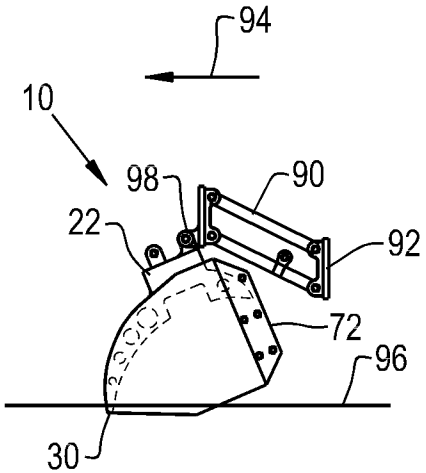
FIG. 11 is a side view of the adjustable material box of FIGS. 9-10 in a back drag position.
Figure 10:
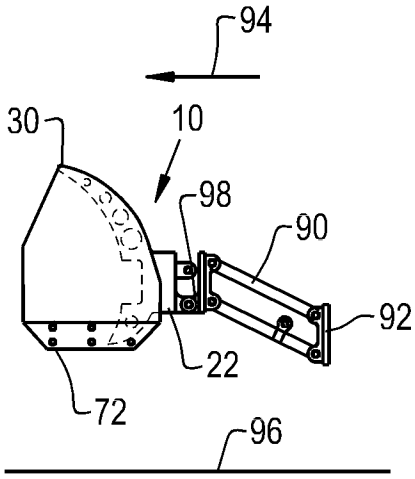
FIG. 10 is a side view of the adjustable material box of FIG. 9 in a transitioning position.
Figure 9:
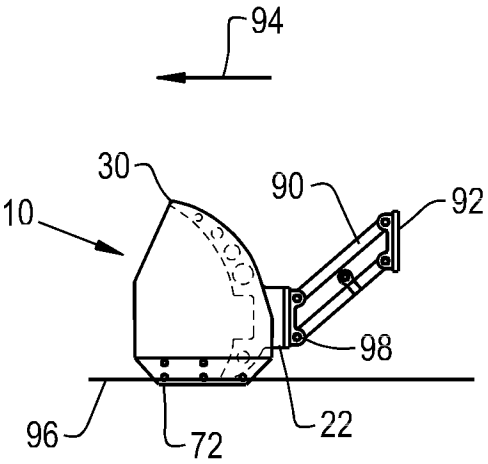
FIG. 9 is a side view of the adjustable material box of FIG. 1 attached to a positioning machine of a vehicle in a forward motion position.

The front center cutting edge 30, which may also be referred to as a back drag blade, allows for the material box assembly 10 to not only push material while the material box assembly 10 is being advanced forward, but also as the material box assembly 10 is being advanced backwards. Referring now to FIGS. 9-11, the material box assembly 10 is shown attached to a positioning machine 90 of a vehicle 92, which can be the skid loader designated as 12 in FIG. 1 or any other type of vehicle that can connect to and move the material box assembly 10. The positioning machine 90 can be any type of assembly or construction that can be used to controllably change the position and orientation of the material box assembly 10 relative to the vehicle 92. As can be seen, the positioning machine 90 of the vehicle 92 connects to the mount 22 of the material box assembly 10, which is shown as a mounting plate. As shown in FIG. 9, the material box assembly 10 is positioned by the positioning machine 90 so that material can be pushed forward, with the vehicle 92 advancing forward in a direction designated by arrow 94. In this position, the back drag cutting edge 72 of the center main blade 20 is contacting a surface 96 that the material will be pushed along. In some situations, it may be useful to use an edge of the material box assembly 10 other than the back drag cutting edge 72 to move material in the backward direction, which will be the direction opposite of the arrow 94. Referring now to FIGS. 10 and 11, the positioning machine 90 is shown raising the material box assembly 10 off the surface 96. The positioning machine 90 can be connected to the mounting plate 22 such that the material box assembly 10 can pivot about a connection point 98 between the mounting plate 22 and the positioning machine 90. Once the material box assembly 10 is raised off the surface 96, the positioning machine 90 can be controlled to allow the material box assembly 10 to pivot about the connection point 98 so that the back drag blade 30 is contacting the surface 96, as shown in FIG. 11. In this position, the back drag blade 30 will be the edge that contributes to pushing material in the backward direction as the vehicle 92 advances backwards. Such a position is useful for moving material that is in a difficult to access surface for the back drag cutting edge 72 of the material box assembly 10. By altering the position of the material box assembly 10 by the positioning machine 90, the back drag blade 30 can be utilized to effectively reach the material and move it.

Figure 12:
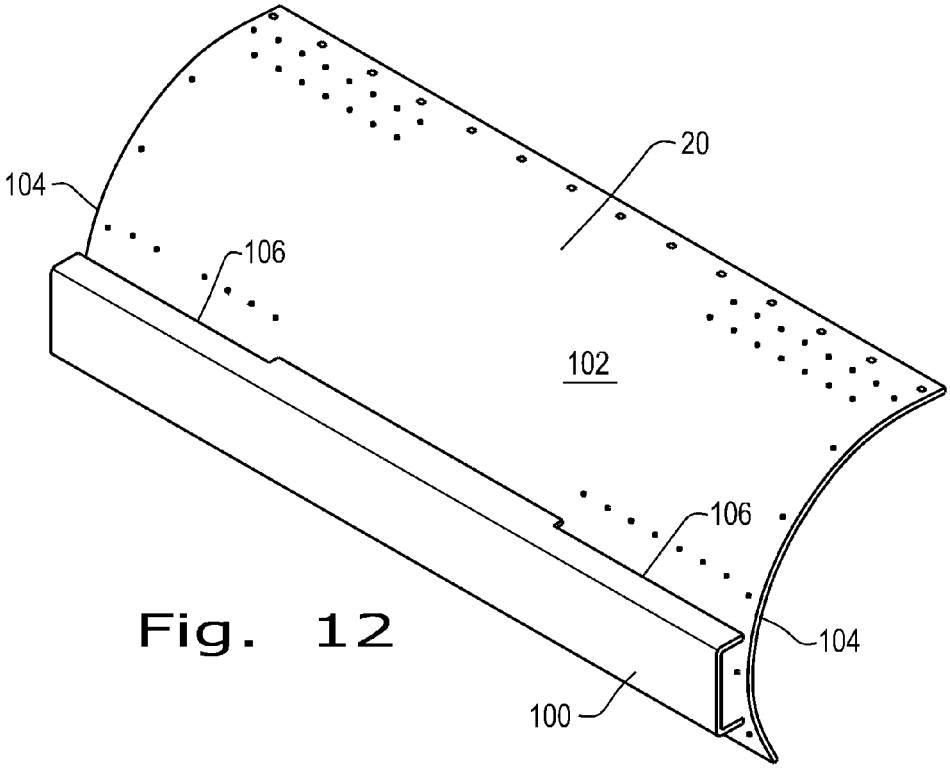
FIG. 12 is a perspective view of a center main blade attached to an alternate embodiment of a C-shaped channel according to the present invention.
Figure 13:
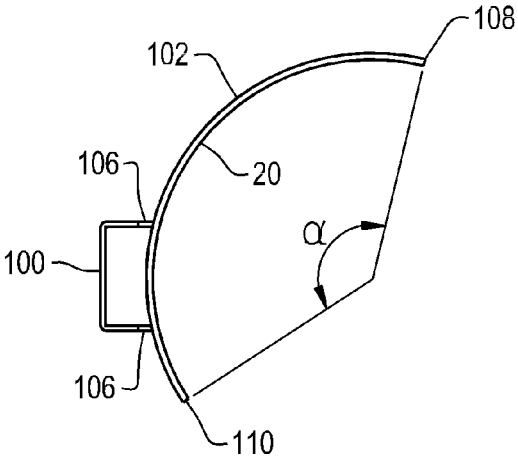
FIG. 13 is a side view of the center main blade and attached C-shaped channel shown in FIG. 12.
Figure 14:
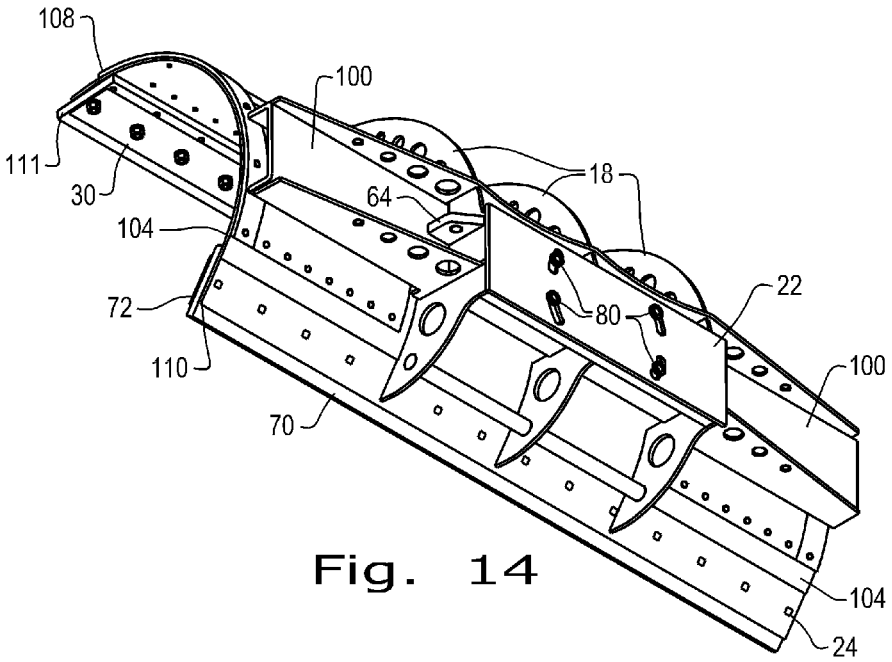
FIG. 14 is a perspective view of the center main blade shown in FIGS. 12-13 with other attached components.

While the material box assembly 10 shown in FIGS. 1-8 has a center blade assembly 14 with a C-channel frame 16 including lips that extend toward each other formed in the channel 16, the lips can be removed without straying from the scope of the invention. Referring now to FIGS. 12-14, the center main blade 20 is shown with a C-channel frame 100, which can also be referred to as a channel, attached to a back side 102 of the center main blade 20. As can be seen, the channel 100 extends to both lateral ends 104 of the center main blade 20, but the channel 100 could also extend to only one of the lateral ends 104 if width expansion of the material box assembly 10 is only desired on one lateral end 104 of the center main blade 20. Similar to the previously shown C-channel frame 16, a gap 106 is formed between the channel 100 and the back side 102 of the center main blade 20 to allow for the wing blades 42 to transversely slide within the gap 106 across the back side 102 of the center main blade 20. As can be seen in FIG. 13, the center main blade 20 has a degree of curvature a that is defined between a first line drawn tangentially to a first point 108 corresponding to a first end of the center main blade 20 and a second line drawn tangentially to a second point 110 corresponding to a second end of the center main blade 20. As shown, the degree of curvature a of the center main blade 20 is approximately 130 degrees, but the degree of curvature a could also be increased or decreased to be in a range of values of approximately 70 to 160 degrees.

As can be seen in FIG. 14, the center main blade 20 can include a front center cutting edge 30, which can also be referred to as a back drag blade, attached to a front side of the center main blade 20. As previously described, the back drag blade 30 can be utilized to move material that is difficult to reach by the bottom edge of the center main blade 20, which can have back drag cutting edge 72 attached thereto. The back drag blade 30 can be a separate blade, as shown, or could be a sharpened front edge of the center main blade 20. The back drag blade 30 can be formed from the same material as the center main blade 20 or from a different material than the center main blade 20. Forming the back drag blade 30 from a different material than the center main blade 20 can be useful when it is desired that the back drag blade 30 has a sharper edge than the center main blade 20 which may only be possible if the back drag blade 30 is formed from a different material. The back drag blade 30 can extend past the first end 108 of the center main blade 20, as shown, or be aligned with the first end 108 of the center main blade 20. A flexible material pad 111, such as a rubber pad, can extend past the back drag blade 30 to soften the impact of the back drag blade 30 against a surface, which can extend the longevity of the back drag blade 30. As previously described, the wing blade assemblies 36 and 38 can also include wing back drag cutting edges 72 that can be similarly constructed as the back drag blade 30, relative to the wing blades 42. As the wing back drag cutting edges 72 function similarly to the back drag blade 30, the wing back drag cutting edges 72 can also be configured as separate wing back drag blades or be integrally formed with the wing blades 42.

Figure 15:
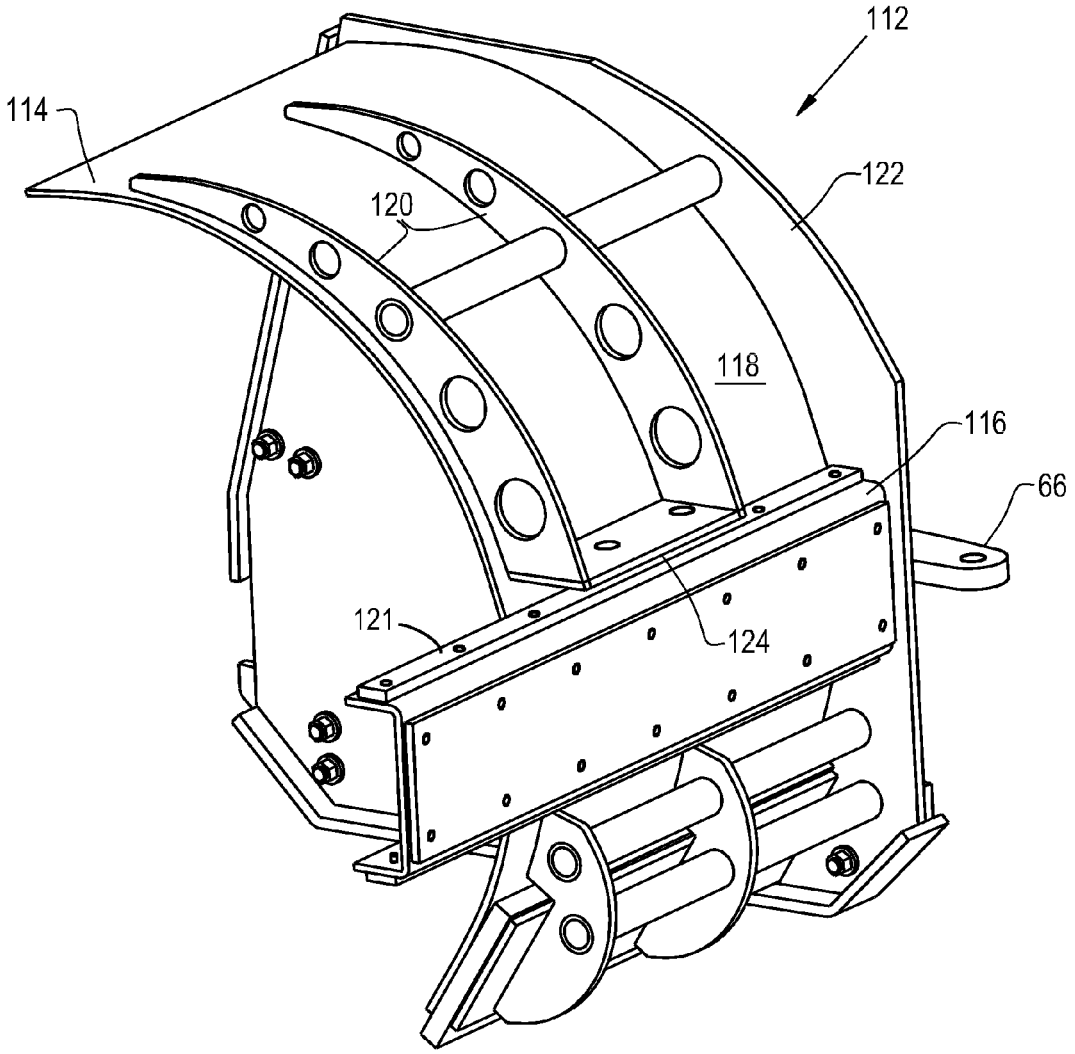
FIG. 15 is a perspective view of an alternate embodiment of a wing blade assembly according to the present invention.

Referring now to FIG. 15, an alternate embodiment of a wing blade assembly 112 is shown that can slide within the channel 100 attached to the center main blade 20 to expand the width of the material box assembly 10. As can be seen, the wing blade assembly 112 includes a wing blade 114 and a wing blade slide 116 attached to a back side 118 of the wing blade 114. The wing blade slide 116 is sized and shaped so that it can be placed and slide within the channel 100, and the wing blade 114 can have a thickness that is approximately the same as the gap 106 so that the wing blade assembly 112 slides along the back side 102 of the center main blade 20 without being loose. Unlike wing blade assemblies 36 and 38, the wing blade assembly 112 does not require a gap defined between the wing blade 114 and the wing blade slide 116 to accommodate sliding over the lips of the C-shaped channel 16. The wing blade assembly 112 can include a wing blade gusset 120 attached to a side frame 122 of the wing blade assembly 112 that can provide support for the wing blade 114 during operation. When the wing blade assembly 112 includes wing blade gusset 120, a wing slide gap 124 can be defined between the wing blade gusset 120 and the wing blade slide 116 to allow for the wing blade assembly 112 to slide within the channel 100 without the wing blade gusset 120 dragging along the top of the channel 100. A slide 121 can be connected to the wing blade slide 116 between the wing blade slide 116 and wing blade gusset 120 that will slide along the channel 100. The slide 121 can be formed from a flexible material or material with a low coefficient of static or sliding friction, relative to the channel 100, to allow the wing blade assembly 112 to more snugly fit within the channel 100 or slide with less possibility of wear on the wing blade 114. If the wing blade assembly 112 includes the slide 121 and one or more wing blade gussets 120, the slide 121 should not extend toward the wing blade gusset(s) 120 so much that there is no wing slide gap 124 defined between the slide 121 and wing blade gusset(s) 120. Without the wing slide gap 124, the wing blade gusset(s) 120 will be pressed against the top of the channel 100 and make sliding of the wing blade assembly 112 more difficult, if not impossible. The wing blade assembly 112 can also include any other features that were included on wing blade assemblies 36 and 38.

Figure 16:
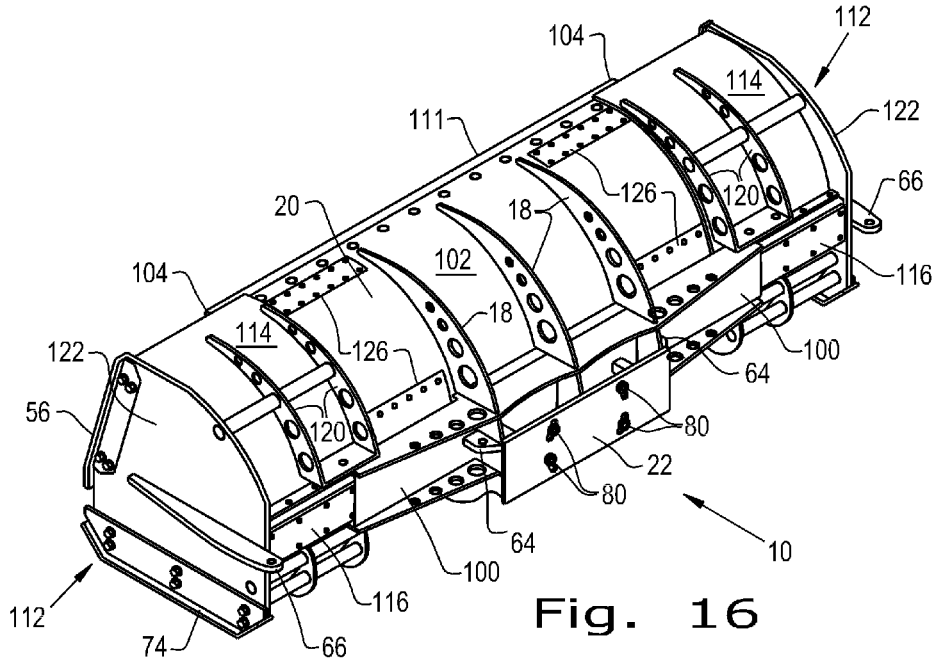
FIG. 16 is a perspective view of the material box assembly that incorporates the C-shaped channel shown in FIGS. 12-14 and two of the wing blade assemblies shown in FIG. 15.

Referring now to FIG. 16, the material box assembly 10 is shown with channel 100, rather than C-shaped channel frame 16, attached to the back side 102 of the center main blade 20 and wing blade assemblies 112 instead of wing blade assemblies 36 and 38. As can be seen, the wing blade assemblies 112 can slide along the back side 102 of the center main blade 20 within channel 100 to adjust the width of the material box assembly 10. Since the channel 100 does not have lips like the C-shaped channel frame 16 shown in FIGS. 1-8, one or more sliding pads 126 can be attached to the back side 102 of the center main blade 20 to provide a sliding surface for the wing blade assemblies 112 across the back side 102 of the center main blade 20. As the wing blade assemblies 112 will be sliding across the sliding pads 126, it is useful if the sliding pads 126 are formed from a material that has a low coefficient of sliding friction relative to the wing blades 114 to reduce the amount of wear that the wing blades 114 will experience during sliding of the wing blade assemblies 112. When one or more sliding pads 126 is attached to the center main blade 20 to provide a sliding surface for the wing blade assemblies 112, the gap 106 that the wing blade 114 slides in can be at least partially defined between the sliding pad(s) 126 and the channel 100, depending on the location of the sliding pad(s) 126 relative to the lateral end(s) 104 of the center main blade 20.

While the above description and drawings describe a material box assembly having adjustable wings on both sides thereof, in some embodiments, only one side of the material box assembly may be adjustable. Moreover, while the above description and drawings describe a material box assembly that is adjustable, the present invention may include other attachments having a similar adjustment mechanism, such as plows, box blades, rakes, and the like.

It should be understood, of course, that the foregoing relates to exemplary embodiments of the invention and that modifications may be made without departing from the spirit and scope of the invention as set forth in the following claims.

What is claimed is:

1. A material moving assembly, comprising:

a center blade assembly having a center main blade, said center main blade having a curved plate structure, said center main blade having a pair of lateral ends;

at least one channel attached to a back side of said curved plate structure of said center main blade, said at least one channel extending to at least one of said pair of lateral ends of said center main blade, said at least one channel having a C-shaped cross sectional shape, said at least one channel and said back side of said center main blade defining a first gap therebetween at a lateral end of said at least one channel; and at least one wing blade assembly having a wing blade, wherein said at least one wing blade assembly includes a wing blade slide that is slidably engaged with said at least one channel to adjust the width of the material box, whereby said wing blade is slidable in transverse directions within said first gap at the back side of the center main blade, each said wing blade slide having a cross sectional shape which mates with and slides within said C-shaped cross sectional shape of a corresponding said at least one channel, each said wing blade being positioned behind said center main blade and having a curvature that allows transverse sliding of the wing blade relative to the center main blade.

2. The material moving assembly of claim 1, further comprising at least one slide disposed along the wing blade slide, the at least one slide reducing friction between said at least one channel and the wing blade slide.

3. The material moving assembly of claim 1, wherein said center main blade includes a front center cutting edge.

4. The material moving assembly of claim 1, further comprising at least one wing upper gusset on each wing blade and at least one lower cutting edge gusset on each wing blade.

5. The material moving assembly of claim 4, wherein said at least one wing upper gusset and said wing blade slide define a wing slide gap therebetween.

6. The material moving assembly of claim 1, further comprising a sliding pad attached to said back side of said center main blade, said sliding pad and said at least one channel defining at least a portion of said first gap therebetween.

7. The material moving assembly of claim 1, further comprising a mount adapted to attach the material box assembly to a vehicle.

8. The material moving assembly of claim 7, wherein said mount is a mounting plate.

9. The material moving assembly of claim 1, wherein said at least one channel includes a pair of opposed lips extending toward each other.

10. A material moving assembly, comprising:

a center blade assembly having a center main blade, said center main blade having a curved plate structure, said center main blade having a pair of lateral ends, said center main blade including a back drag blade defining an edge of said center main blade;

at least one channel attached to a back side of said curved plate structure of said center main blade, said at least one channel extending to at least one of said pair of lateral ends of said center main blade, said at least one channel having a C-shaped cross sectional shape, said at least one channel and said back side of said center main blade defining a first gap therebetween at a lateral end of said at least one channel; and at least one wing blade assembly having a wing blade, wherein said at least one wing blade assembly includes a wing blade slide that is slidably engaged with said at least one channel to adjust the width of the material box, whereby said wing blade is slidable in transverse directions within said first gap at the back side of the center main blade, each said wing blade slide having a cross sectional shape which mates with and slides within said C-shaped cross sectional shape of a corresponding said at least one channel, each said wing blade being positioned behind said center main blade and having a curvature that allows transverse sliding of the wing blade relative to the center main blade.

11. The material moving assembly according to claim 10, wherein said center main blade has a first end, a second end, and a degree of curvature defined between said first end and said second end.

12. The material moving assembly according to claim 11, wherein said degree of curvature is in a range of between 70 to 160 degrees.

13. The material moving assembly according to claim 12, wherein said degree of curvature in a range of between 115 to 145 degrees.

14. The material moving assembly according to claim 10, further comprising a mounting plate adapted to attach said material box assembly to a vehicle.

15. The material moving assembly according to claim 10, wherein said back drag blade is attached to a front side of said center main blade.

16. The material moving assembly according to claim 10, wherein said back drag blade and said center main blade are formed from the same material.

17. The material moving assembly according to claim 10, wherein said back drag blade and said center main blade are formed from different materials.

18. The material moving assembly according to claim 10, wherein said back drag blade is a front center cutting edge.

19. The material moving assembly according to claim 10, wherein said at least one channel includes a pair of opposed lips extending toward each other.

* * * * *